US005493980A

United States Patent [19]

Nishimori et al.

[11] Patent Number: 5,493,980

[45] Date of Patent: Feb. 27, 1996

[54] SEWING MACHINE

[75] Inventors: Shigeru Nishimori; Tooru Kuroishi, both of Okayama, Japan

[73] Assignee: Matsuka Co., Okayama, Japan

[21] Appl. No.: 261,923

[22] Filed: Jun. 17, 1994

[30] Foreign Application Priority Data

Sep. 30, 1993 [JP] Japan ..... 5-245604

[51] Int. Cl.[6] ..... D05B 19/00

[52] U.S. Cl. ..... 112/470.03; 112/309; 112/318; 112/320

[58] Field of Search ..... 112/112.11, 309, 112/308, 306, 318, 322, 314, 153, 320, 121.15, 470.03, 470.01

[56] References Cited

U.S. PATENT DOCUMENTS 3,970,017 7/1976 Babson et al. ..... 112/309 X
4,117,790 10/1978 Hasegawa et al. ..... 112/309
5,033,399 7/1991 Miyachi et al. ..... 112/306 X
5,186,115 2/1993 Rouleau et al. ..... 112/306
5,289,788 3/1994 Fukumoto ..... 112/308 X

*Primary Examiner*—Peter Nerbun
*Attorney, Agent, or Firm*—Nikaido Marmelstein Murray & Oram

[57] ABSTRACT

A sewing machine adapted to sew an edge of a workpiece such as a floor mat which is mounted on a sewing table includes a sensor means adapted to monitor a contour of the workpiece and transmit monitored information, a feeding means adapted to turn the workpiece in accordance with the contour of the workpiece so as to successively feed the workpiece into a sewing area, and a control mechanism adapted to control the feeding means in accordance with the monitored information transmitted from the sensor means.

18 Claims, 13 Drawing Sheets

C5
C4
C3
C2
C1
7a
7
4
28

C1
C2
C3
C4
C5
4
7
7a
28

SEWING MACHINE

BACKGROUND OF THE INVENTION

1. Field of the Invention

This invention relates to a sewing machine, more particularly to an improvement in structure for a sewing machine which is designed to effectively sew an edge of a floor mat for an automobile or the like along its varying contour.

2. Description of the Prior Art

A typical conventional sewing machine comprises a mounting table, on which a workpiece such as a floor mat for an automobile (commonly referred to as a "car mat") or the like is mounted, a sewing mechanism adapted to sew an edge of the workpiece mounted on the mounting table, a rotating mechanism adapted to rotate the mounting table, a vertically moving means adapted to vertically move the mounting table, and a horizontally moving mechanism adapted to horizontally move the mounting table.

The sewing machine of this arrangement is disadvantageous in the fact that since it needs programming to control the rotating mechanism, and the vertically and horizontally moving mechanisms to be moved in accordance with each contour of the workpiece to be sewn. This programming was troublesome and consequently decreased the efficiency of sewing operation. In addition, when the workpiece of a different contour is to be sewn, the program must be revised so as to properly control those mechanisms. When the workpiece particularly the car mat of a varying contour with relatively many corners is to be sewn, program had to be revised frequently. This was a serious problem in the sewing machine of this type.

Further, actuators comprising the rotating mechanism described would become large in dimension, since it has to move the mounting table which is generally heavy in weight. Consequently the overall structure of the sewing machine may undesirably become bulky.

SUMMARY OF THE INVENTION

Thus, it is an object of the present invention to provide a sewing machine which enables an operator to readily operate the machine.

Another object of the present invention is to provide a sewing machine which has a novel structure, namely means for moving a workpiece on a fixed mounting table which enables the machine to be designed in simple and small.

Pursuant to the above objects, the sewing machine adapted to sew an edge of a workpiece such as a floor mat which is mounted on the mounting table, includes a sensor means for monitoring the contour of the workpiece and transmitting monitored information, a feeding means for turning the workpiece in accordance with the contour of the workpiece so as to feed the workpiece into a sewing area, and a control mechanism for controlling the feeding means in accordance with the monitored information transmitted from the sensor means.

The feeding means includes a feeding roller which is reversibly rotated, and a pressing roller which moves towards and away from the feeding roller so as to timely press the workpiece in cooperation with the feeding roller.

The sensor means includes a swing arm which is swingable and has a detecting bar adapted to abut against the edge of the workpiece, and a means for monitoring a swing angle of the swing arm.

In the sewing machine of the above arrangement, the workpiece is first mounted on the mounting table. Then the sewing machine is actuated such that the edge of the workpiece is sewn as it moves forward. When the edge is sewn, the sensor means simultaneously monitors the contour of the workpiece. Accordingly, for example, when the sensor means detects a corner of the workpiece, the detected information is transmitted to the control mechanism with the result that the control mechanism properly sets the feeding means into operation.

When the corner of the workpiece reaches the needle, the workpiece is turned about the needle so as to sew the edge of the corner of the workpiece.

When the feeding means comprises the feeding roller which is reversibly rotated, and the pressing roller which moves towards and away from the feeding roller so as to press the workpiece in cooperation with the feeding roller, the workpiece can be pressed at both surfaces with the feeding roller and the pressing roller. Thus the workpiece is securely turned on the mounting table.

Further, when the sensor means comprises the swing arm which is swingable and has the detecting bar which abuts against the edge of the workpiece, and the means for monitoring a swing angle of the swing arm, the detecting bar slides along the edge of the workpiece, whereby swinging the swing arm. The swing angle of this swing arm is monitored by the means, and the monitored information is transmitted to the control mechanism. According to this information, the control mechanism controls the feeding means. Thus, even when the overall edge of the workpiece is of any curved shape, for example, successively concave and convex, it can be readily sewn in the same manner as the case where a straight line is sewn.

BRIEF DESCRIPTION OF THE DRAWINGS

The above, and other objects, features and advantages of the present invention will become apparent from the detailed description read in conjunction with the accompanying drawings, which are given by way of illustration only, and thus are not limitative of the present invention, and wherein.

DETAILED DESCRIPTION OF THE PREFERRED EMBODIMENTS

Figure 1:
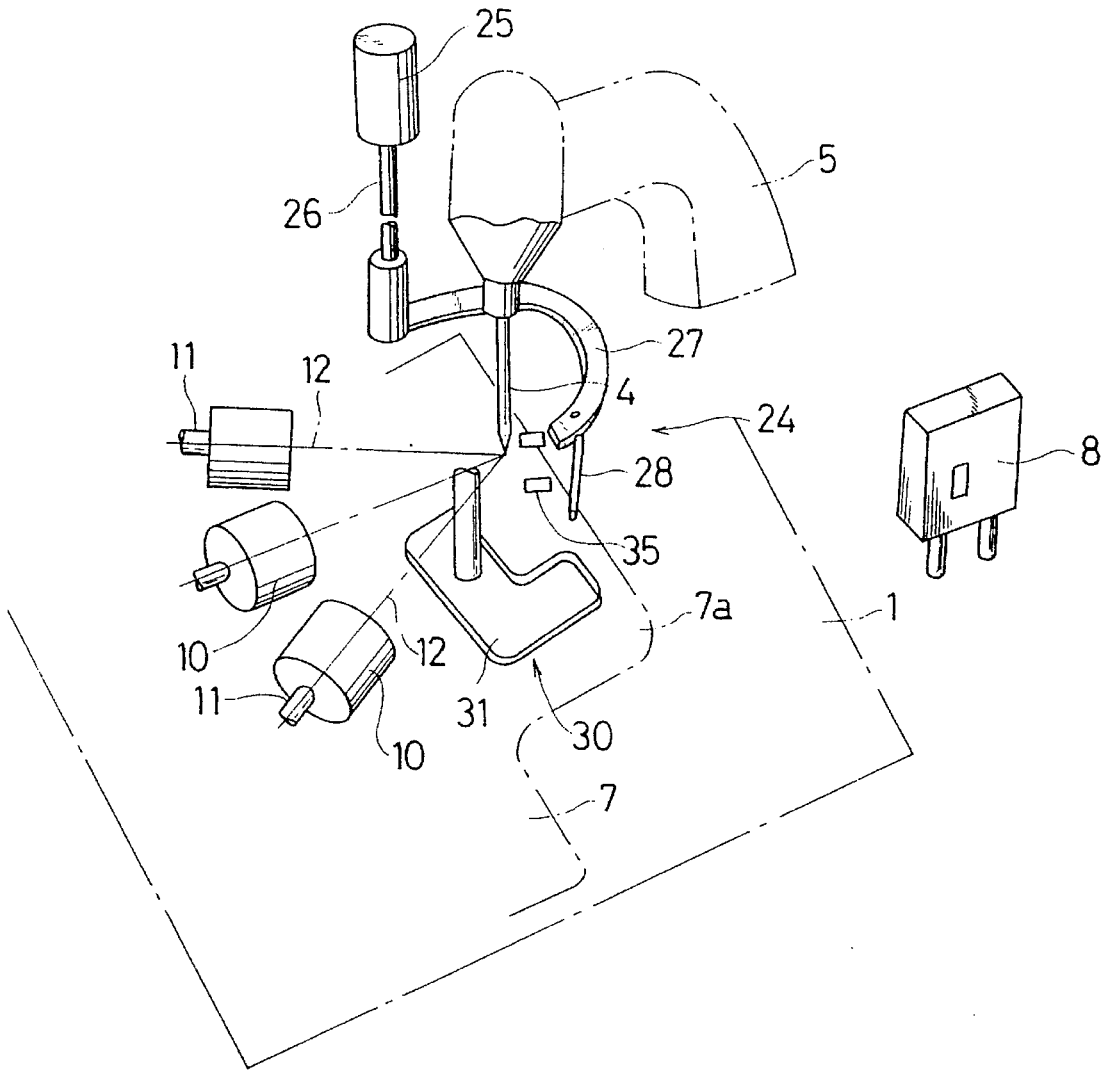
FIG. 1 is a schematic perspective view illustrating one embodiment of a sewing machine of the present invention.
Figure 2:
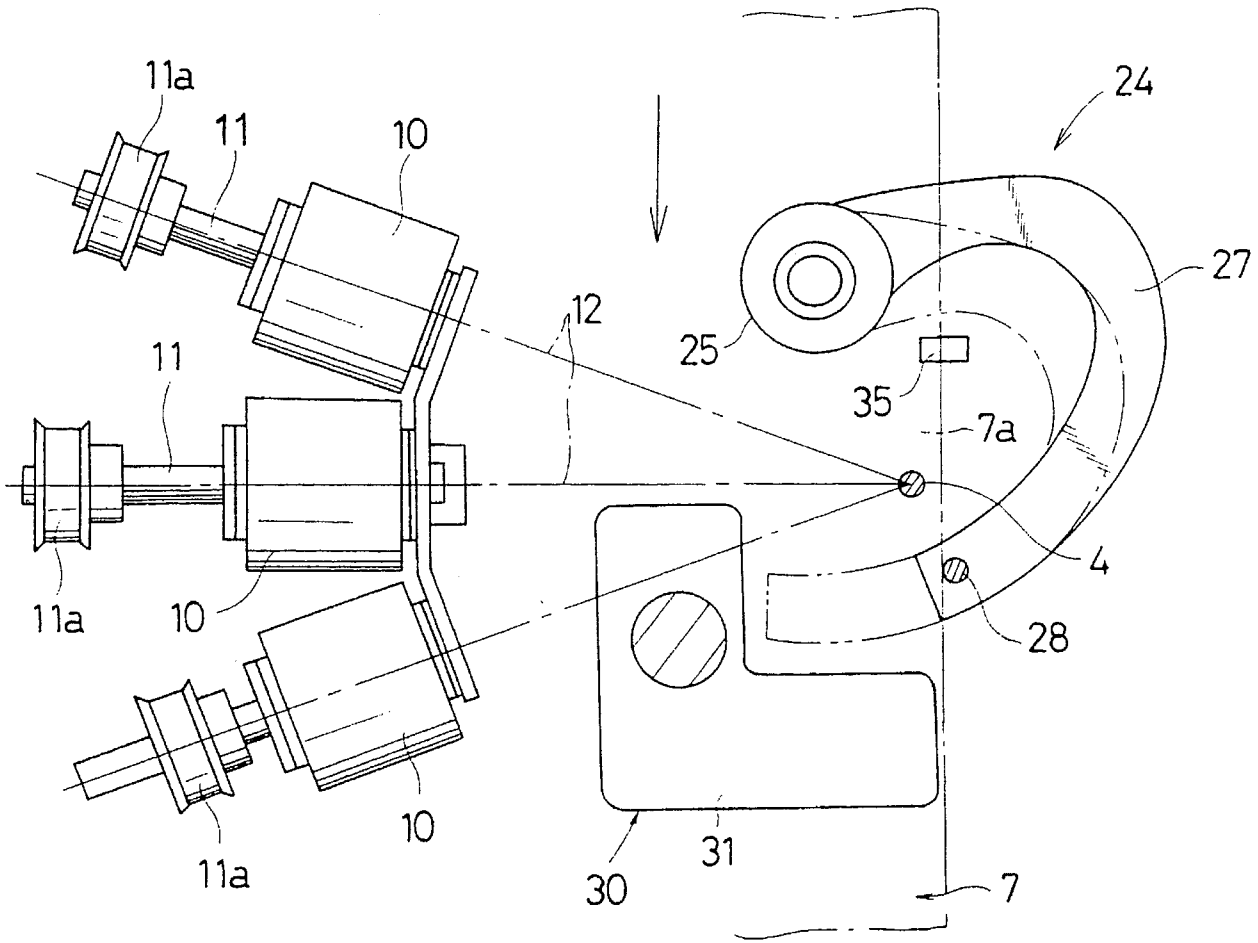
FIG. 2 is a plan view with a partially cross sectional view illustrating an essential part of the sewing machine of FIG. 1.

Referring to FIGS. 1 to 6, a horizontally extending mounting table 1 is securely fixed on a frame 2. A sewing means 5 which has in known manner a vertically reciprocating needle 4, a presser foot (not shown) and a guide plate (not shown) adapted to receive and guide an edge 7*a* of the workpiece 7, is provided adjacent to the mounting table 1. The sewing means 5 is adapted to automatically sew an edge 7*a* of the workpiece 7 which is mounted on the mounting table 1 prior to being sewn.

Figure 4:
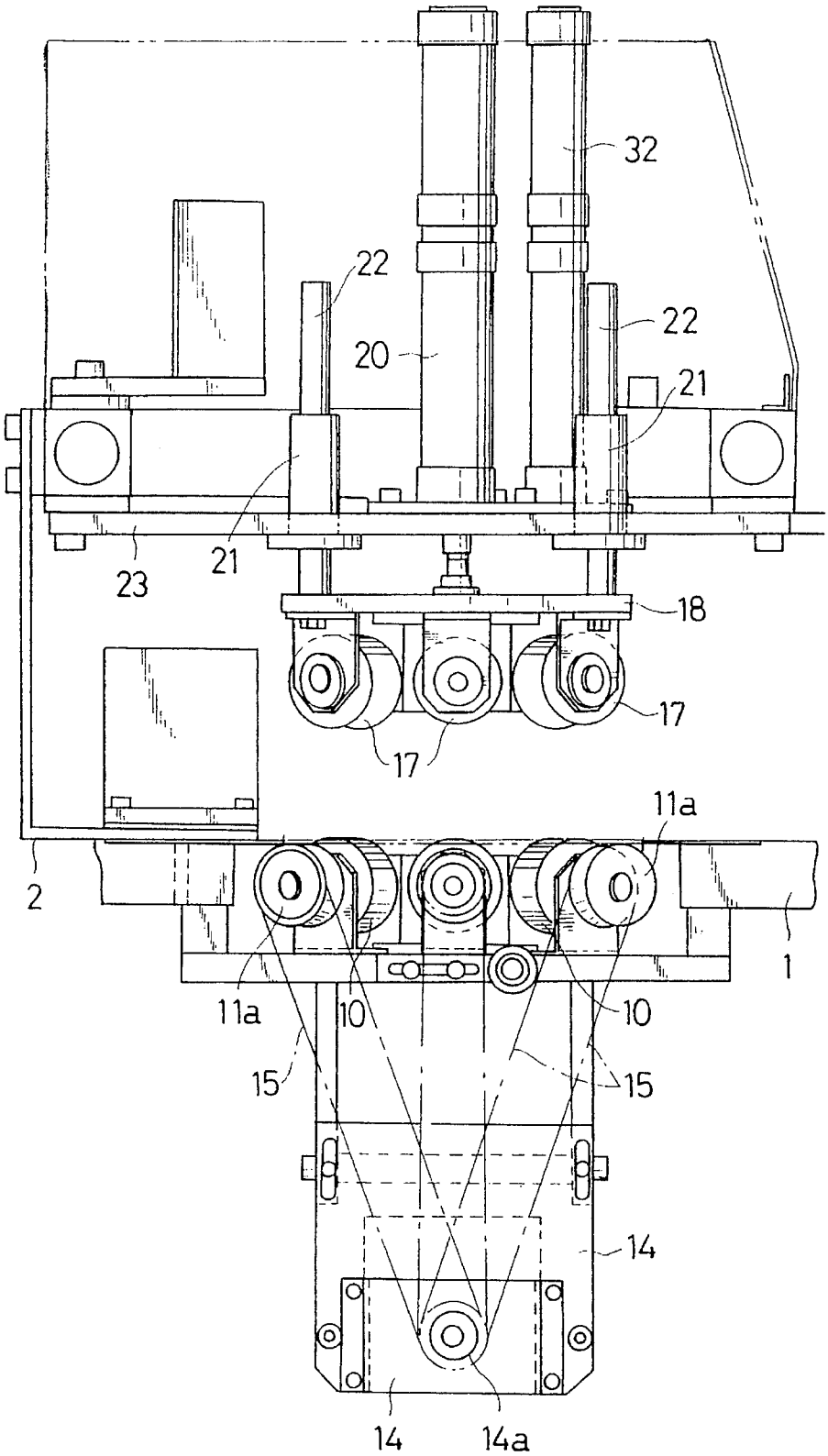
FIG. 4 is a front view illustrating the essential part of the sewing machine of FIG. 1.
Figure 5:
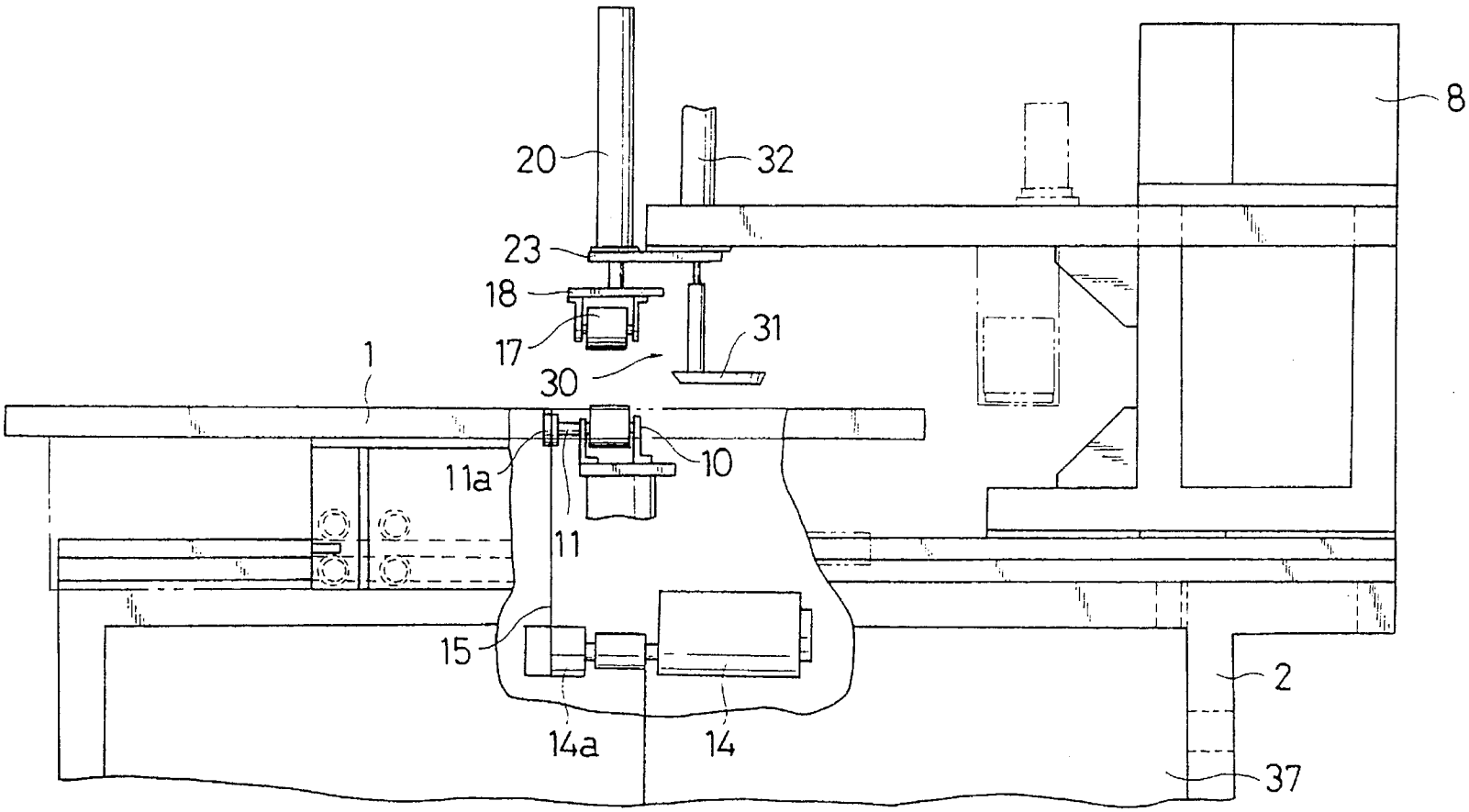
FIG. 5 is a side view with a broken-out section illustrating the essential part of the sewing machine of FIG. 1.

A plurality of feeding rollers 10 are fixed to the frame 2 such that imaginary extension lines 12 of rotational axes 11 thereof lie in a plane and center at the needle 4. Upper ends of the rollers protrude upwardly away from the upper surface of the mounting table 1. A pulley 11*a* is provided on each of the rotation axes 11 of the feeding rollers. An endless belt 15 is wound between the pulley 11*a* and a pulley 14*a* of an electric motor 14 such that the feeding rollers 10 can be reversibly rotated by actuation of the electric motor 14, as best illustrated in FIGS. 4 and 5.

Figure 6C:
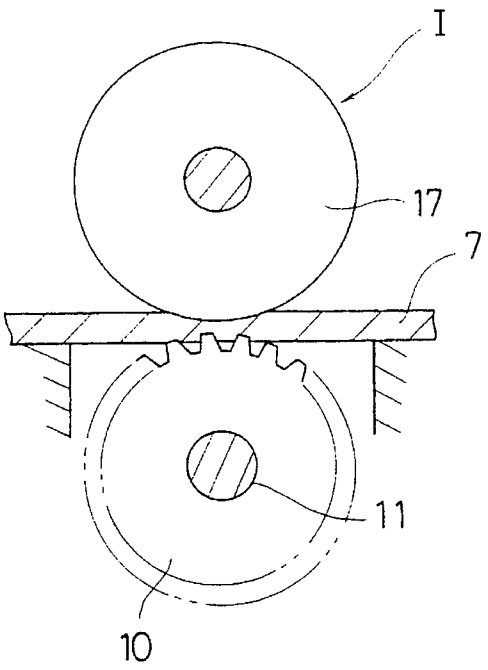
FIGS. 6A, 6B and 6C are cross sectional views illustrating positional relationships between the feeding roller and the pressing roller.
Figure 6B:
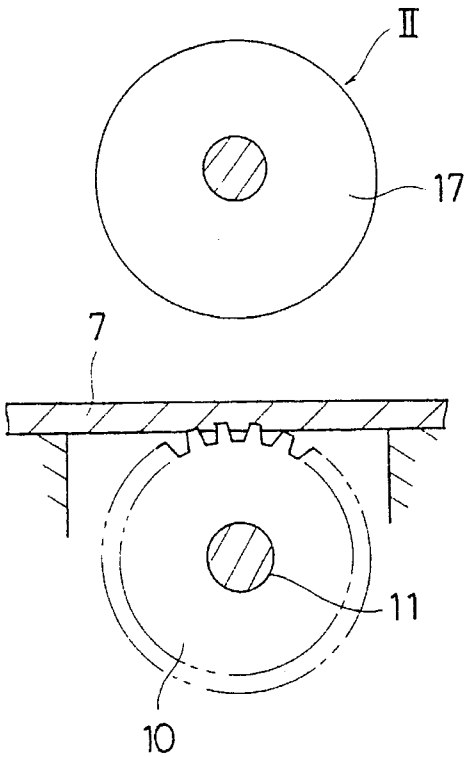
Figure 6A:
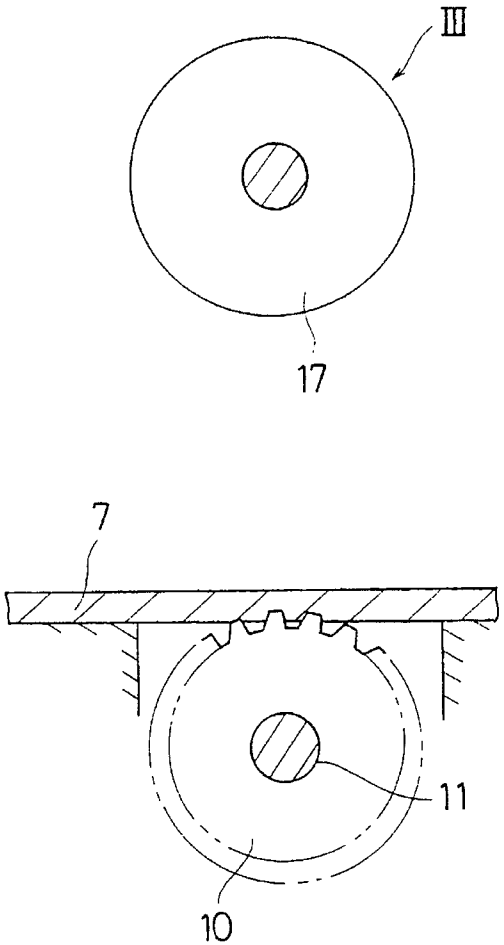

A plurality of pressing rollers 17 are rotatably fixed to a bracket 18 and positioned above the feeding rollers 10 in such a manner as to correspond to the feeding rollers 10 in another plane parallel to the feeding roller plane. The pressing rollers 17 are moved vertically by actuation of a cylinder 20 which is mounted on a mounting plate 23 fixed on the frame 12 so as to be positioned at varying height as illustrated in FIGS. 6A, 6B and 6C. That is, the pressing rollers 17 are positioned at the lowermost position I where it presses the workpiece 7 in cooperation with the feeding rollers 10, the middle position II where the pressing rollers 17 are slightly away from the workpiece 7, and the uppermost position III. Thus the feeding roller 10 and the pressing roller 17 function as a feeding means in cooperation with each other. A pair of guide bars 22 are provided on both sides of the cylinder 20, each of which is slidably inserted into a guiding hollow cylinder 21 mounted on the mounting plate 23.

As best illustrated in FIG. 1, a first sensor means 24 includes a C-shaped swing arm 27, one end of which is fixed to a vertical axis 26 of a rotary encoder 25 which is, in turn, fixed to the frame 2, and a downwardly oriented detecting bar 28, one end of which is fixed to the opposite end of the swing arm 27. The swing arm 27 is pivotally moved about the vertical axis 26 and is tensioned against the workpiece 7 by an elastic member (not shown) as indicated by the imaginary line of FIG. 2 so as to forcibly abut against the edge 7*a* of the workpiece 7. With this arrangement, the rotary encoder 25 monitors the angle via the swing angle of the swing arm 27.

Figure 3:
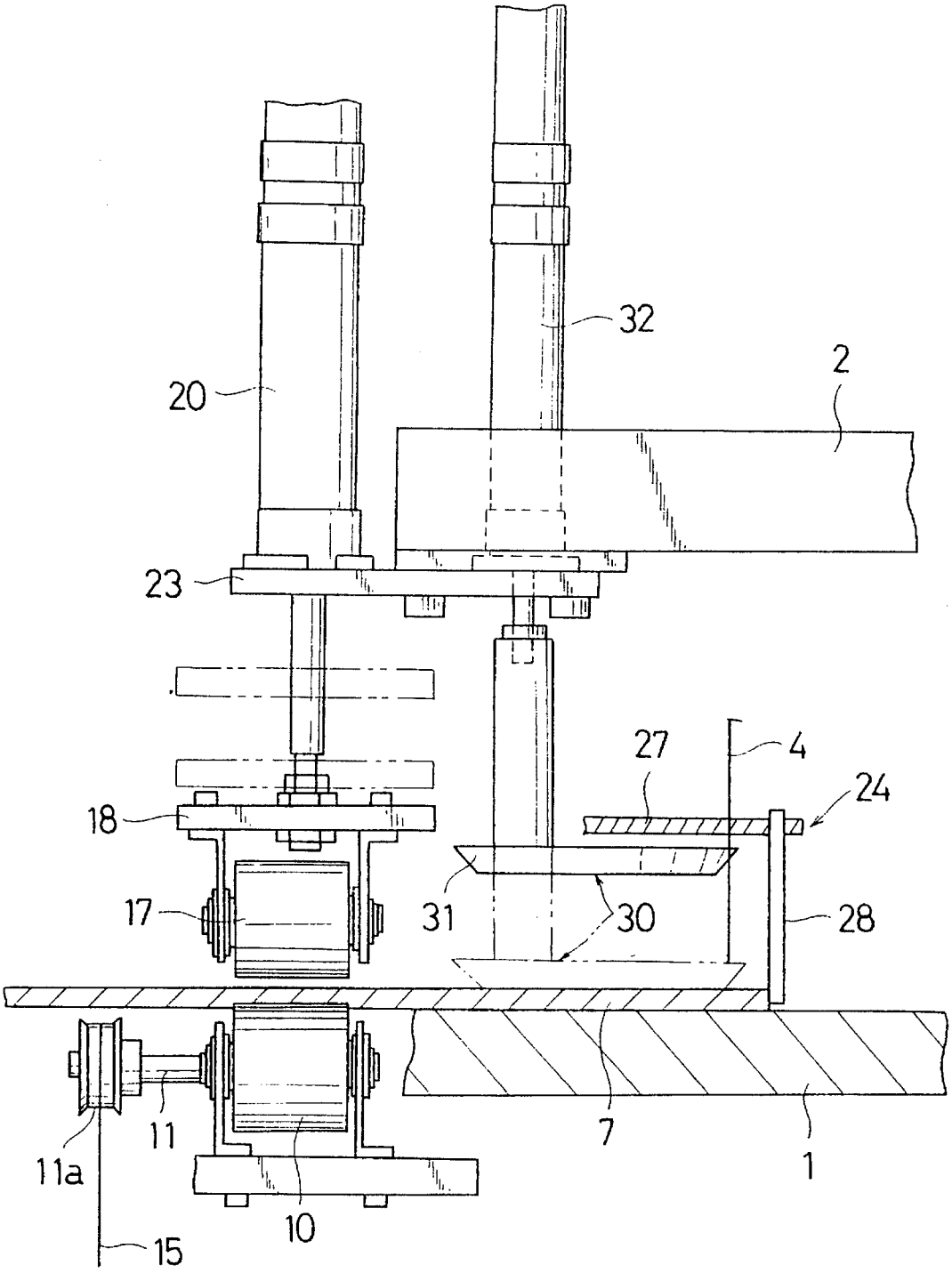
FIG. 3 is a cross sectional side view illustrating the essential part of the sewing machine of FIG. 1.

A pressing means 30 includes a flat pressure pad 31 adapted to press the workpiece 7 so as to prevent turning up of the edge 7*a* of the workpiece 7 which may occur just after the workpiece 7 has been sewn, and an elevating cylinder 32 adapted to vertically move the pressure pad 31, as illustrated in FIGS. 1 and 3. A second sensor means 35 adapted to monitor the contour of the workpiece 7 comprises a pair of optical sensors or photosensors which are respectively disposed above and below the workpiece 7.

Under the frame 2 is provided a control mechanism 37, to which the monitored information is transmitted from the first sensor means 24, the second sensor means 35 and the rotary encoder 25. In accordance with the monitored information, the control mechanism 37 controls the electric motor 14 to drive the sewing means 5 and the feeding rollers 10, the cylinder 20 which vertically moves the pressing rollers 17, and the elevating cylinder 32 which vertically moves the pressing member 31.

In operation, after the workpiece 7 is mounted on the mounting table 1, the presser foot (not shown) is moved downwardly so as to press the workpiece 7 by actuating the control box 8. The number of corners C (5 corners in this embodiment) are inputted to the control mechanism 37 via, for example, a digital counter. Then, the control mechanism 37 sets the sewing means 5 and the electric motor 14 into operation so as to rotate the feeding rollers 10 in such a direction that the workpiece 7 is fed forwardly, and actuates the cylinder 20 so as to lower the pressing rollers 17 to the middle position II under the control of the control mechanism 37. All through these operations, the feed pitch of the sewing means 5 is set at a standard amount.

Figure 7:
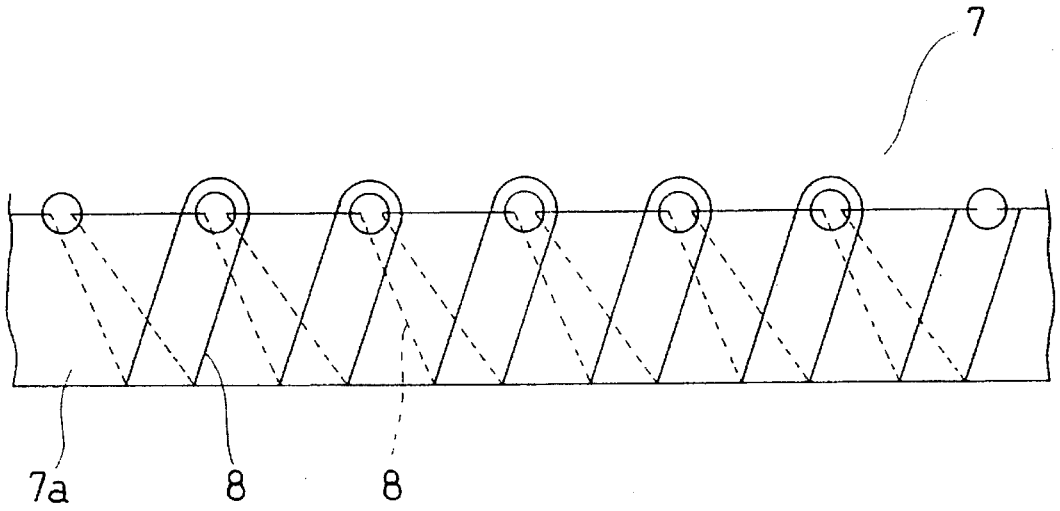
FIG. 7 is an enlarged plan view illustrating a sewing state of the edge of the workpiece.

FIG. 7 illustrates one of sewing types which is applied to the edge 7*a* of the workpiece 7. However it is to be noted that varying sewing type may be applied to this edge 7*a* with the machine of the present invention.

Figures 8A, 8B, 8C, 8D:
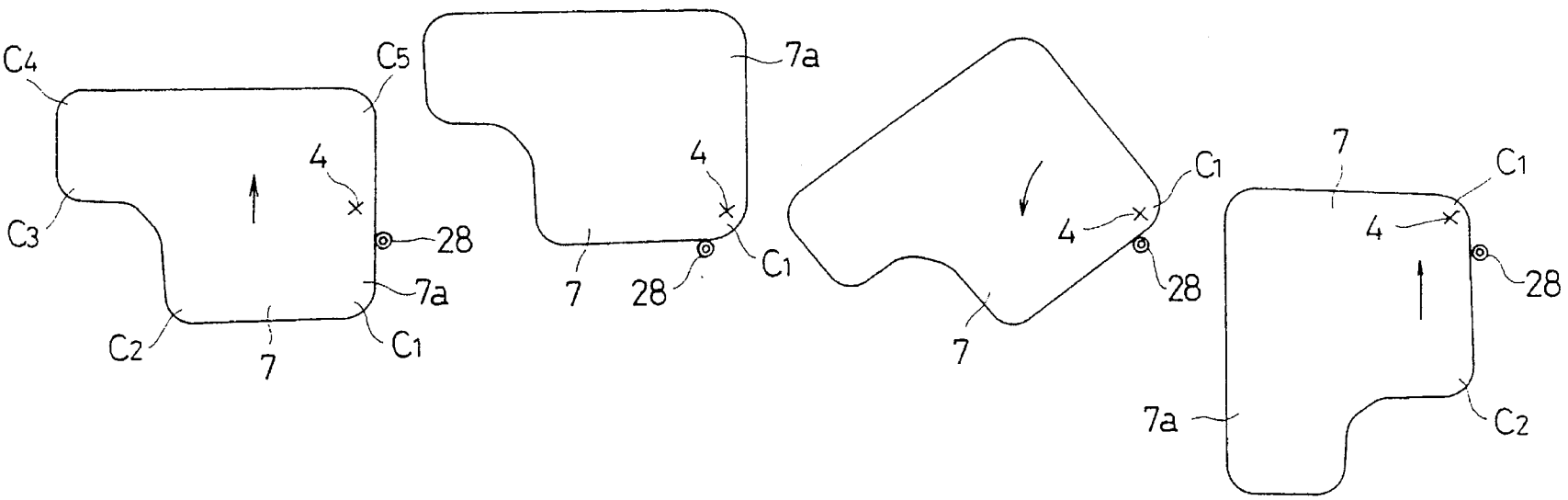
FIGS. 8A, 8B, 8C and 8D are plan views illustrating sewing states of the workpiece.

FIGS. 8A, 8B, 8C and 8D illustrate a first stage of the sewing operation. In FIG. 8A, the workpiece 7 is moved in the direction of the arrow such that the straight portion of the edge 7*a* can be sewn. During this operation, the detecting bar 28 slides along the edge 7*a*. In FIG. 8B, a first corner C1 reaches the detecting bar 28. Then the swing arm 27 pivots so as to conform around the first corner C1. The rotary encoder 25 detects this swing angle of the swing arm 27 and transmits the detected information to the control mechanism 37. In FIG. 8C, in accordance with the detected information relating to the first corner C1, the feed pitch of the sewing means 5 is set at a smaller amount relative to the standard such that the first corner C1 is properly and equally sewn. The pressing rollers 17 are lowered to the lowermost position I and press the workpiece 7. Under this state, the feeding rollers 10 are reversely rotated such that the workpiece 7 is turned about 90° in the direction of the arrow around the needle 4 to such a position that the edge 7*a* is positioned parallel to the feeding direction of the workpiece 7, as illustrated in FIG. 8D.

After the workpiece 7 is thus turned, the feed pitch of the sewing means 5 is returned to the standard amount. The pressing rollers 17 are raised to the middle position II. The feeding rollers 10 are forwardly rotated in the direction of the arrow of FIG. 7D so as to feed the workpiece 7 straight. If the first sensor means 24 or the second sensor means 35 detects any delays when the workpiece 8 is fed, these sensor means control the pressing rollers 17 to be lowered and press the workpiece 7, and the feeding rollers 10 to be rotated at high speed. On the contrary, if the workpiece 7 is moved too fast, the feeding rollers 10 are controlled to stop its rotation or slow down its rotational speed.

In the forthcoming description of FIGS. 9, 10, 11 and 12, some relative motions of the workpiece 7, the feeding rollers 10, the pressing rollers 17, the sensor means 24 and 35, and the like, which are identical to those in the first stage of the sewing operation illustrated in FIGS. 8A, 8B, 8C and 8D, will not be described in detail hereinafter, since the sewing machine sews outwardly curved corners of the workpiece 7 substantially in the same manner as described above.

Figures 9A, 9B, 9C, 9D:
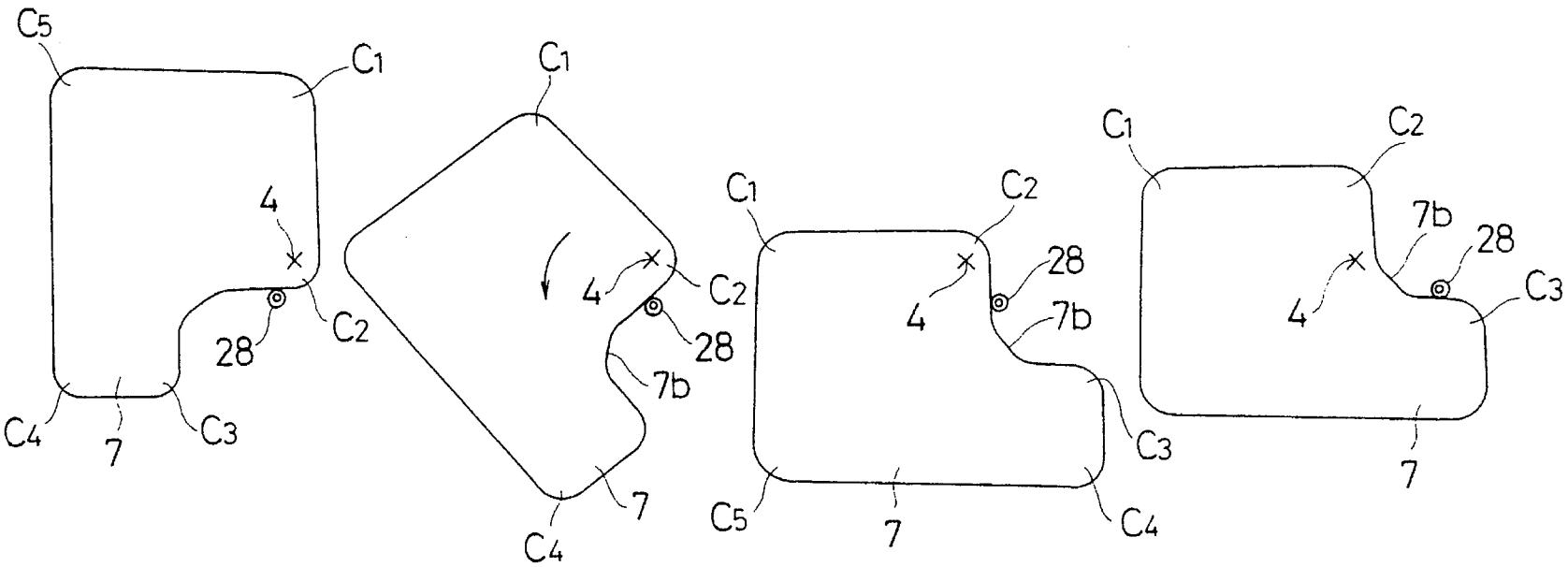
FIGS. 9A, 9B, 9C and 9D are plan views further illustrating sewing states of the workpiece.

FIGS. 9A, 9B, 9C and 9D illustrate a second stage of the sewing operation. In FIG. 9A, when a second corner C2 reaches the detecting bar 28, the feed pitch of the sewing means 5 is set at the smaller amount, as in the first corner C1. In FIG. 9B, the pressing rollers 17 are moved downwardly to the lowermost position I so as to press the workpiece 7. Under this state, the feeding rollers 10 are reversely rotated such that the workpiece 7 is turned about 90° in the direction of the arrow. In FIG. 9C, the detecting bar 28 detects an end portion of the second corner C2. Then, the feed pitch of the sewing means 5 is returned to the standard amount. In FIG. 9D, an inwardly curved portion reaches the detecting bar 28. Then the swing arm 27 swings in the direction opposite to that in the corners as described above. Whereby the detecting bar 28 detects the presence of the inwardly curved portion, and transmits the detected information relating to this curved portion to the control mechanism 37 with the result that the feed pitch of the sewing means 5 is set at a larger amount relative to the standard.

Figures 10A, 10B, 10C, 10D:
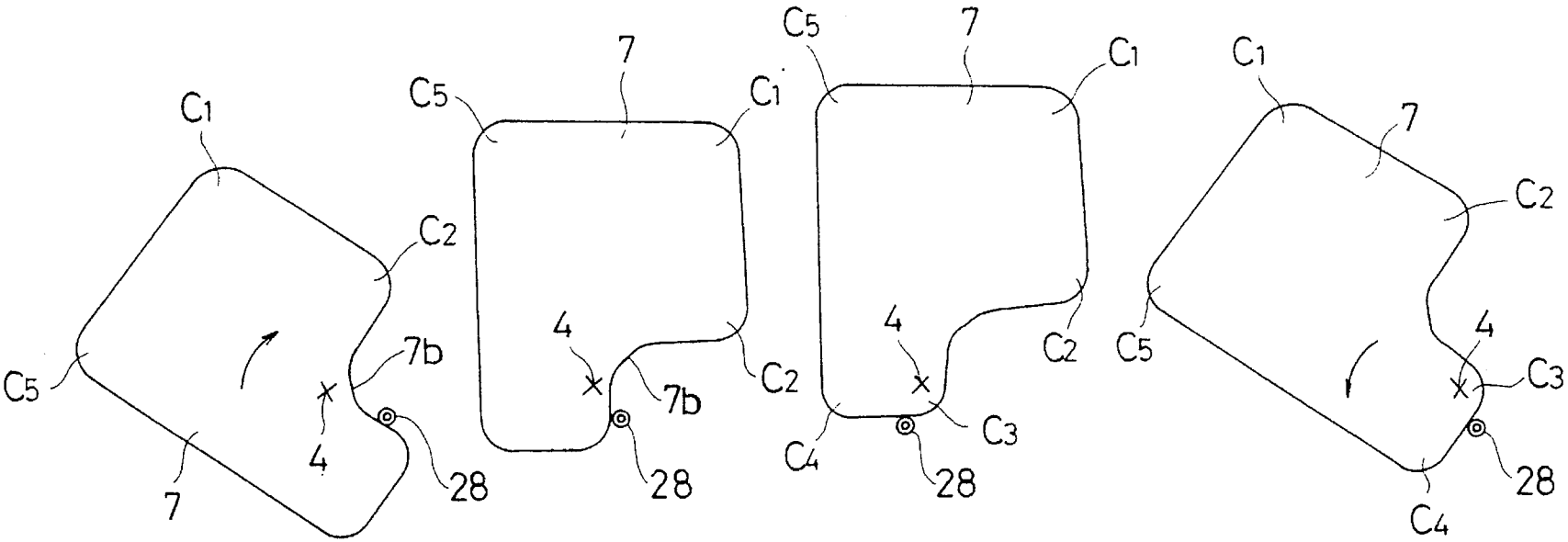
FIGS. 10A, 10B, 10C and 10D are plan views further illustrating sewing states of the workpiece.

FIGS. 10A, 10B, 10C and 10D illustrate a third stage of the sewing operation. In FIG. 10A, the feeding rollers 10 are forwardly rotated at high speed. Thus, the inwardly curved portion is properly and equally sewn as the workpiece 7 is turned in the direction of the arrow. In FIG. 10B, the detecting bar 28 detects an end of the inwardly curved portion. Then, the feed pitch of the sewing means 5 is returned to the standard amount. In FIG. 10C, the detecting bar 28 detects the presence of a third corner C3, and the feed pitch of the sewing means 5 is set at the smaller amount. In FIG. 10D, the feeding rollers 10 are reversely rotated such that the workpiece 7 is turned in the direction of the arrow and the edge 7*a* is properly sewn as is in the first and second corners.

Figures 11A, 11B, 11C, 11D:
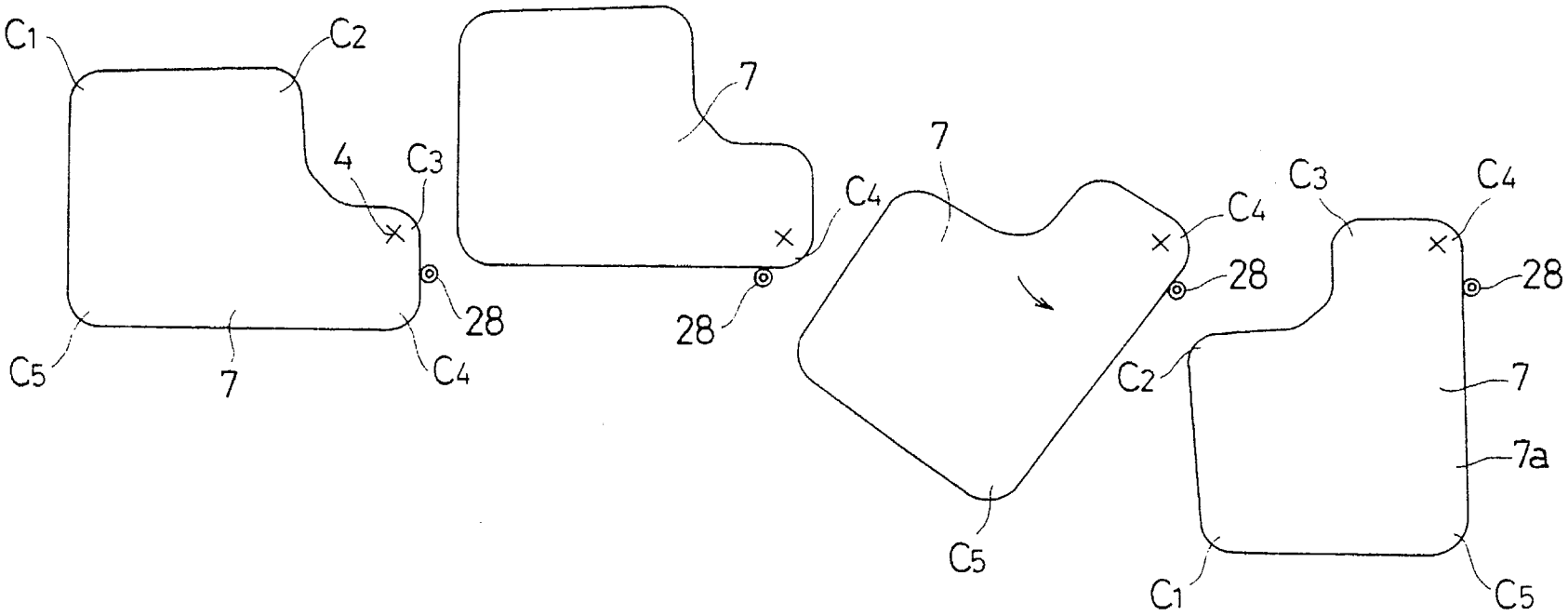
FIGS. 11A, 11B, 11C and lid are plan views further illustrating sewing states of the workpiece.

FIGS. 11A, 11B, 11C and 11D illustrate a fourth stage of the sewing operation. In FIG. 11A, the detecting bar 28 detects an end of the third corner C3, and subsequently the feed pitch of the sewing means 5 is returned to the standard amount. In FIG. 11B, a fourth corner C4 is detected and the feed pitch of the sewing means 5 is set at the smaller amount. In FIG. 11C, the feeding rollers 10 are reversely rotated such that the workpiece 7 is turned in the direction of the arrow. In FIG. 11D, an end of the fourth corner C4 is detected and the feed pitch of the sewing means 5 is returned to the standard amount.

Figure 12A:
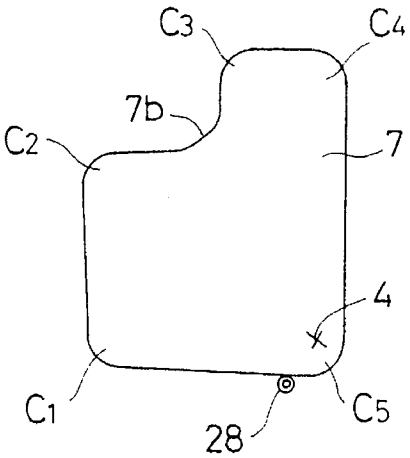
FIGS. 12A, 12B, 12C and 12D are plan views further illustrating sewing states of the workpiece.
Figure 12B:
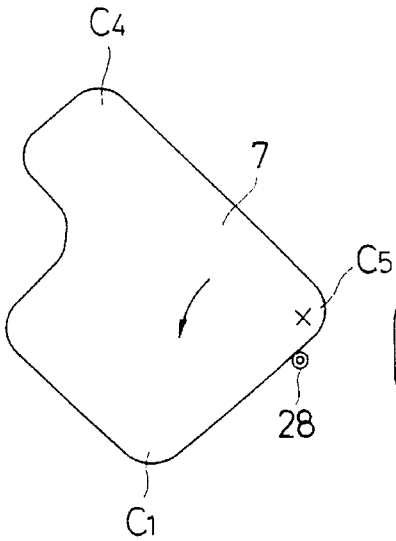
Figure 12C:
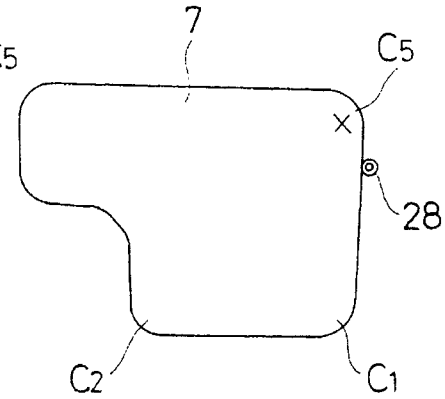
Figure 12D:
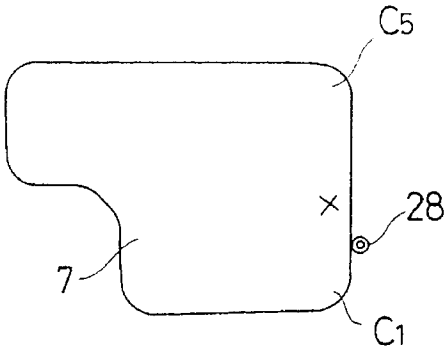

FIGS. 12A, 12B, 12C and 12D illustrate the last stage of the sewing operation. In FIG. 12A, a fifth corner C5 is detected with the result that the feed pitch of the sewing means 5 is set at the smaller amount. In FIG. 12B, the feeding rollers 10 are reversely rotated such that the workpiece 7 is turned in the direction of the arrow. In FIG. 12C, after an end of the fifth corner C5 is detected by the first sensor means 24 and the second sensor means 35, a timer mechanism (not shown) of the control mechanism 37 is set into operation so as to automatically stop the sewing means 5 and the feeding rollers 10 in a predetermined period of time, during which the residual straight portion of the edge 7*a* is sewn, as illustrated in FIG. 12D. The overall edge 7*a* of the workpiece 7 is thus securely sewn, and the sewing operation is finished.

When a radius of curvature of the corner of the workpiece 7 is relatively large, it is difficult for the first sensor means 24 to solely detect the exact contour thereof via the swing motion of the swing arm 27. In this case, the second sensor means 35 supports the first sensor means 24 to exactly detect such a corner and other curved portion.

Thus the sewing machine in accordance with this embodiment can securely detect the edge 7*a* of the workpiece 7 via both the first sensor means 24 and the second sensor means 35, in which the first sensor means 24 has the detecting bar 28 which is designed to abut against the edge of the workpiece 7. Therefore, even when a pile or the like of the workpiece 7 falls sidewards protruding outwardly from the edge of the workpiece 7, and subsequently the second sensor means 35 wrongly detects the contour of the workpiece due to such disturbances of a protruding pile or the like, the first sensor means 24 can securely detect the exact contour of the workpiece 7.

Further, since a series of the sewing operation can be automatically carried out by merely inputting the number of the corners of the workpiece 7 and starting the machine, it is unnecessary for the operator to monitor the machine during its operation. Thus, a plurality of the machines can be concurrently operated by a single operator, which adds to the effective sewing operation and the reduction of the number of the required operators.

Figure 13:
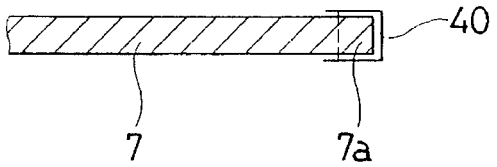
FIG. 13 is a cross sectional view illustrating another embodiment of the present invention.

It is to be noted that this invention is not limited to the above embodiment. It is possible to dispose a dust collector or the like below the frame 2 so as to collect waste pieces of threads or other remnants generated from the sewing operation. Further, although the sewing means 5 has been exemplified in the above embodiment, a means of other type for treating the edge of the workpiece 7, for example, a tape sewing means which is designed to attach and sew a longitudinal tape 40 onto the edge of the workpiece 7, ends of which are positioned on the upper surface and the lower surface of the workpiece 7 may be substituted for the sewing means 5, as illustrated in FIG. 13.

Figure 14:
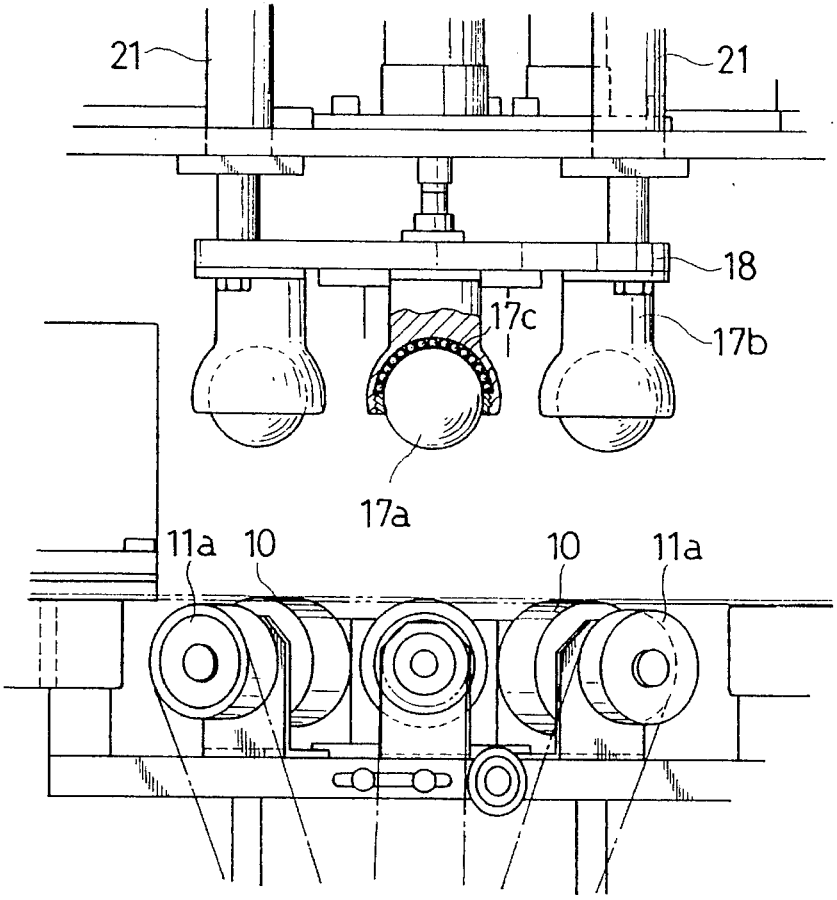
FIG. 14 is a front view of another embodiment of the present invention.

Referring to FIG. 14, a spherical pressing means which comprises a ball 17*a* adapted to be rotated in varying directions, a supporting member 17*b* and a spherical concave 17*c* can be employed instead of the roller 17. This spherical pressing means can omit exessive forces applied to a particular portion of the workpiece 7 between the spherical pressing means and the guide plate of the sewing means 5 due to uneven surfaces of the workpiece 7 or high-speed feeding by relatively loosely feeding the workpiece 7 in cooperation with the feeding roller 10. Thus undesirable deformation or the like of the workpiece 7 can be effectively avoided.

As is apparent from the above description, it is a matter of course that the workpiece 7 to be sewn is not limited to the above described contour, but the workpiece of any contour such as the workpiece with its edge wholly curved can be readily sewn, since the detecting bar 28 securely follows the edge of the workpiece 7. The machine of this arrangement is effective particularly for a round corner. However, a radius of the round corner and a contour of the corner are not limited to the above embodiments.

Further, the sewing machine of the present invention is effective when it is applied to the car mat commonly having varying contour, and in addition it may be applied to any floor mat used such as in an entrance of a house, a living room, or the like.

This specification is by no means intended to restrict the present invention to the preferred embodiments set forth therein. Various modifications to the inventive sewing machine, as described herein, may be made by those skilled in the art without departing from the spirit and scope of the present invention.

What is claimed is:

1. A sewing machine for sewing an edge of a workpiece such as a floor mat which is mounted on a sewing table, comprising a sensor means for continually monitoring a contour of said workpiece and transmitting monitored information, said sensor means including a swing arm which is swingable about an axis parallel to an axis of a needle of the sewing machine and is provided with a detecting bar abutting against the edge of said workpiece, and a means for monitoring a swing angle of said swing arm, a feeding means for turning said workpiece in accordance with said contour of said workpiece so as to successively feed said workpiece into a sewing area, and a control mechanism for controlling said feeding means in accordance with the monitored information transmitted from said sensor means.

2. The sewing machine as set forth in claim 1, wherein said feeding means comprises a feeding roller which is reversely rotated, and a pressing means which moves towards and away from said feeding roller for timely pressing said workpiece in cooperation with said feeding roller.

3. The sewing machine as set forth in claim 1, wherein said means for monitoring a swing angle of said arm is a rotary encoder.

4. The sewing machine as set forth in claim 2, wherein a plurality of said feeding rollers are arranged such that the rotational axes thereof are oriented towards the needle.

5. A sewing machine comprising a sewing table, on which a workpiece such as a floor mat is mounted, a sewing means provided with a vertically oriented needle for sewing an edge of said workpiece mounted on said sewing table, a sensor means for continually monitoring an outer contour of said workpiece and transmitting monitored information, said sensor means including a swing arm which is swingable about an axis parallel to an axis of said needle and is provided with a detecting bar abutting against the edge of said workpiece, and a means for monitoring a swing angle of said swing arm, a feeding means for turning said workpiece in accordance with said contour of said workpiece so as to successively feed the workpiece into a sewing area, and a control mechanism for controlling said feeding means in accordance with the monitored information transmitted from said sensor means.

6. The sewing machine as set forth in claim 5, wherein said feeding means comprises a feeding roller which is reversibly rotated, and a pressing means which moves towards and away from said feeding roller for timely pressing said workpiece in cooperation with said feeding roller.

7. The sewing machine as set forth in claim 6, wherein a plurality of said feeding rollers are arranged such that the rotational axes thereof are oriented towards said needle.

8. The sewing machine as set forth in claim 5, wherein said means for monitoring a swing angle of said arm is a rotary encoder.

9. A sewing machine for sewing an edge of a workpiece such as a floor mat which is mounted on a sewing table, comprising a sensor means for continually monitoring an outer contour of said workpiece and transmitting monitored information, a feeding means for turning said workpiece in accordance with said contour of said workpiece so as to successively feed said workpiece into a sewing area, said feeding means including a plurality of feeding rollers which are reversibly rotated and arranged such that the rotational axes thereof are oriented towards a needle in the sewing area, and at least one pressing means which moves towards and away from the corresponding feeding roller for timely pressing said workpiece in cooperation with said corresponding feeding roller, and a control mechanism for controlling said feeding means in accordance with the monitored information transmitted from said sensor means.

10. The sewing machine as set forth in claim 9, wherein said pressing means comprises a roller.

11. The sewing machine as set forth in claim 9, wherein said pressing means is a spherical pressing means rotatable in varying directions.

12. The sewing machine as set forth in claim 9, wherein said sensor means comprises a swing arm which is swingable and is provided with a detecting bar abutting against the edge of said workpiece, and a means for monitoring a swing angle of said swing arm.

13. The sewing machine as set forth in claim 12, wherein said means for monitoring a swing angle of said arm is a rotary encoder.

14. A sewing machine for sewing an edge of a workpiece such as a floor mat which is mounted on a sewing table, the sewing machine comprising a sewing means for sewing at a predetermined feed pitch and including a needle, a sensor means for monitoring an outer contour of said workpiece by abutting against the edge of said workpiece and transmitting monitored information, a feeding means for turning said workpiece in accordance with said contour of said workpiece so as to successively feed said workpiece into a sewing area, and a control mechanism for controlling said feeding means and said sewing means in accordance with the monitored information transmitted from said sensor means, wherein the feed pitch of the sewing means is set at a smaller amount relative to a standard when sewing an outwardly curved portion, and is set at a larger amount when sewing an inwardly curved portion, while the feeding means turns said workpiece at a relatively low speed in said outwardly curved portion, and turns said workpiece at a high speed in said inwardly curved portion, whereby said workpiece can be substantially equally sewed.

15. The sewing machine as set forth in claim 14, wherein said feeding means comprises a feeding roller which is reversibly rotated, and a pressing means which moves towards and away from said feeding roller for timely pressing said workpiece in cooperation with said feeding roller.

16. The sewing machine as set forth in claim 14, wherein said sensor means comprises a swing arm which is swingable and is provided with a detecting bar abutting against the edge of said workpiece, and a means for monitoring a swing angle of said swing arm.

17. The sewing machine as set forth in claim 15, wherein a plurality of said feeding rollers are arranged such that the rotational axes thereof are oriented towards said needle.

18. The sewing machine as set forth in claim 14, wherein said means for monitoring a swing angle of said arm is a rotary encoder.

* * * * *